US005890233A

United States Patent [19]

Kaffka

[11] Patent Number: 5,890,233

[45] Date of Patent: Apr. 6, 1999

[54] VISOR SYSTEM FOR LIGHT SPORTS HELMETS

[76] Inventor: Michael G. Kaffka, 787-22 St., West Vancouver BC, Canada, V7V-4C1

[21] Appl. No.: 743,726

[22] Filed: Nov. 6, 1996

[51] Int. Cl.[6] ..... A42B 1/08

[52] U.S. Cl. ..... 2/424; 2/10; 2/6.3; 2/6.4; 2/6.5

[58] Field of Search ..... 2/424, 10, 6.3, 2/6.4, 6.5, 6.7, 431, 432, 435, 438

[56] References Cited

U.S. PATENT DOCUMENTS

| | | | |
|---|---|---|---|
| 3,585,638 | 6/1971 | Aileo . | |
| 3,748,658 | 7/1973 | Albright . | |
| 4,907,300 | 3/1990 | Dampney et al. | 2/424 |
| 5,005,221 | 4/1991 | Chen . | |
| 5,091,997 | 3/1992 | Foehl | 2/424 |
| 5,113,535 | 5/1992 | Hedges et al. . | |
| 5,131,101 | 7/1992 | Chin | 2/424 |
| 5,230,101 | 7/1993 | Hedges et al. | 2/424 |

FOREIGN PATENT DOCUMENTS

| | | | |
|---|---|---|---|
| 515753 | 12/1992 | European Pat. Off. | 2/424 |
| 3637373 | 11/1988 | Germany | 2/424 |

*Primary Examiner*—Gloria M. Hale

[57] ABSTRACT

A dual visor assembly that is designed for and is attachable to any light sports helmet. The lenses are interchangeable by being attached to offset pivoting arms rotating about a common shaft on each side of the helmet. The lenses when raised are locked in the inoperative position and can be lowered by touching a release knob just behind the pivot shaft on either side of the helmet. Each side releasing a different lens.

9 Claims, 5 Drawing Sheets

VISOR SYSTEM FOR LIGHT SPORTS HELMETS

BACKGROUND OF THE INVENTION

This invention relates to a dual visor system for light sports helmets specifically of the type used by cyclists.

Several devices have been patented for use by motorcyclists, prior devices are disclosed in U.S. Pat. Nos. 3,585,638 issued to Aileo, 5,005,221 issued to Chew, 3,748, 658 issued to Albright and 5,113,535 issued to Hedges, et. al.

Without exception theses prior devices are far too heavy to be used on a light sports helmet. Also, the prior art devices are bolted or screwed to the sturdy high impact motorcycle helmet shells. The light sports type helmet has no point strong enough to accommodate this type of attachment. Many of the prior art devices are "full face" visors covering the entire face or joining at the bottom with a chin protection part of the helmet, while this type of visor works well for a person sitting comfortably on a motorized machine, if would fog up immediately if worn by someone peddling a bicycle.

Most examples of prior art have very complicated systems to raise and lower the visor. These systems would be too expensive to manufacture and too difficult to operate while peddling. Most prior art forms are produced either as part of a helmet or specifically for one type of motor cycle helmet. To change or replace the visors on the prior art form requires tools and considerable time to do the job. Prior art with dual visor systems do not have the option of interchanging outside and inside visor.

OBJECTS AND ADVANTAGES

The invention is designed primarily for cyclists who when traveling through a bright sunlit area to a dark shadowed area or vice versa would wish to relieve the strain on their eyes. To attempt to put on or take off their sunglasses while in motion would be dangerous. My invention eliminates this problem by allowing the rider to lower or raise one or two of the lenses by a quick touch of the hand.

ACCORDINGLY SEVERAL OBJECTS AND ADVANTAGES OF MY INVENTION ARE

Simplicity of manufacture and operation with light weight parts and uncomplicated design. There are no expensive springs, bearings or machine parts to clog or break. This simple design and construction ensures that the invention is as light weight as possible. Simplicity in design also means ease of operation. A slight pressure and short movement of one hand deploys one visor and the same motion with the other hand deploys the second visor. By simply pushing on the bottom edge of the visor it is returned out of the field of view and automatically locked there.

Unlike the majority of prior art forms that are designed for a specific helmet this invention is intended to be used with almost all examples of light weight bicycle type helmets. It can be attached in very short order without the need for tools of any kind. Also, unlike most prior art forms with dual visor systems that have specific inside and outside lenses, this inventions lenses are interchangeable without the use of tools. Lenses are so easy to change that extras can be taken to change as the weather changes. The friction fit system for holding the lens in place not only allows for the easiest method of changing but is a safety device. If one or both lenses is snagged, instead of twisting the helmet or in the worst case unseating the rider, the lenses are pulled out of their holders. If the cyclist is unfortunate enough to take a fall and have the side of the helmet contact the ground or some other object, parts of the invention are designed to break or become detached before too much twisting motion is transferred to the helmet by the visor system. These and further objects and advantages of my invention will become apparent from a consideration of the drawings and ensuing description.

SUMMARY OF THE INVENTION

A dual overlapping visor system designed for the light sports bicycle type helmet. The invention allows the rider to lower the inside or outside visor by a small pressure and movement of either hand. The system is designed to be as light and simple as possible, with interchangeable one lens fits all versatility. The lenses are easily installed by simply pushing a visor tab into the pivot arm slot where it is held in place by friction. The control pivot devices have offset pivot holes, placing one ahead and the other behind thus allowing the lens to be interchangeable. The whole system is so designed as to be disconnected from the helmet if sufficient force is placed upon it that there is a danger of twisting the helmet.

DESCRIPTION OF DRAWINGS

FIGS. 3, 3*a*, 4, 4*a*, 5, 5*a* are shown for clarity without the dust cover.

DRAWING REFERENCE NUMERALS

Figure 1:
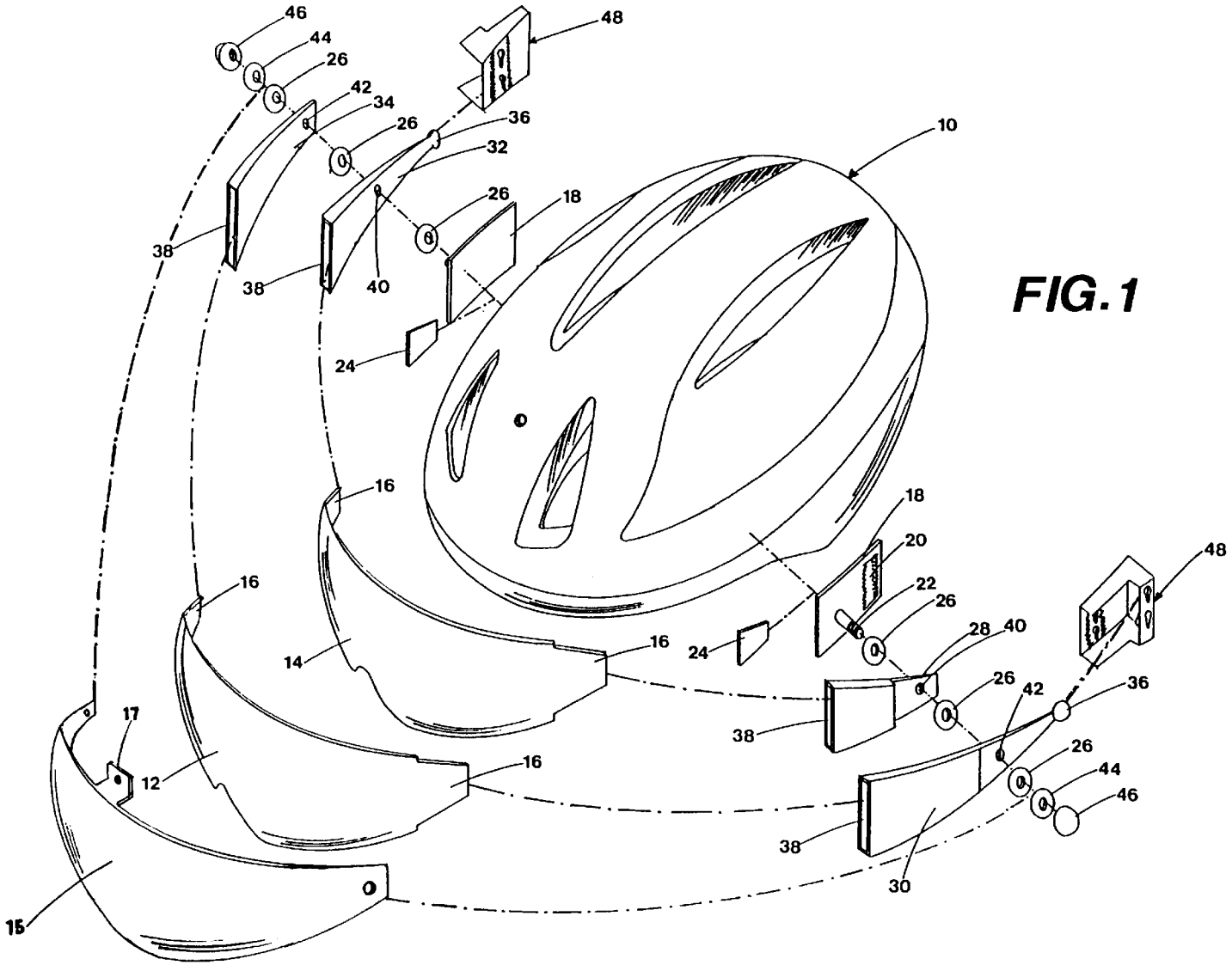
FIG. 1 is a simplified exploded view of my invention.

10 Helmet
12 Lens (shown as outside)
14 Lens (shown as inside)
15 Dust cover
16 Lens tab
17 Securing tab
18 Base plate
20 Stop adjusting slot
22 Shaft
24 Wedge Shims
26 Washer
28 Inside Idler Pivot Arm

30 Outside Control Pivot Arm
32 Inside Control Pivot Arm
34 Outside Idler Pivot Arm
36 Release Knob
38 Pocket
40 Inside Pivot Hole
42 Outside Pivot Hole
44 Tension Washer
46 Cap
48 Pivot Stop Assembly
50 Bridge
52 Control Pivot Down Stop
54 Control Pivot Up Stop
56 Idler Pivot Up Stop
58 Idler Pivot Down Stop
60 Adjusting Impression
62 Screw
64 Adjustment Slot
66 saw Tooth Control Pivot Lock
Lens Pocket

DETAILED DISCLOSURE WITH REFERENCE TO DRAWINGS

FIG. 1 shows a light weight helmet, 10 and the invention in exploded view. On either side of the helmet at the lower edge approximately halfway back are base plates 18 attached by adhesive. Attached to or a part of the mounting plate is a shaft 22 on which is situated or rotate the following in order moving out from the plate. Washer 26 for separation and friction reduction. On one side of the helmet is an inside idler pivot device 28. On the other side is an inside control pivot device 32. Both idler pivot 28 and control pivot 32 have a slot or pocket 38 to receive the tab 16 portion of the visor 14. Equal distance back from the forward edge of the pocket 38 is a hole 40 through which the shaft 22 passes. Another washer 26 separates the inside pivot devices 28 and 32 from the outside control pivot device 30 on one side and idler pivot device 34 on the other. Both of these have slots identical to those of the inside pivots to receive tab 16 of the outside lens 12. It is to be noted that each side has an idler device 28 or 34 and a control device 30 or 32. Also note that each side is the reverse of the other. If one side has an inside control 32 the other will have an inside idler 28. It is of no consequence which combination is on the right or the left side so long as one is the reverse of the other.

A vital difference between the outside devices 30 and 34 and the inside devices 28 and 32 is that the hole 42 in the outside devices is further back from the front of the pocket 38 than hole 40 of the inside devices. This automatically places lens 12 forward of lens 14 which allows them to bypass each other without interference. This has the added advantage of allowing lenses to be manufactured with the same dimension between right and left tabs 16 thereby ensuring that lenses are interchangeable.

A last Washer 26 is followed by the protective cover 15 which is kept from rotating by a securing tab 17 which is screwed directly into the helmet cover.

The items on each shaft are finished off with a tension washer 44, and finally a locking cap 46.

Returning to the base plate 18 it is shown with a wedge shim 24 that can be placed between the underside of the base plate and the helmet to adjust the adhering surface of the plate to variations of helmets produced by different manufacturers. Several such shims would be supplied. On the back part of the base plate is found the pivot stop adjustment slot 20 this slot accommodates the pivot stop assembly 48.

Figure 2:
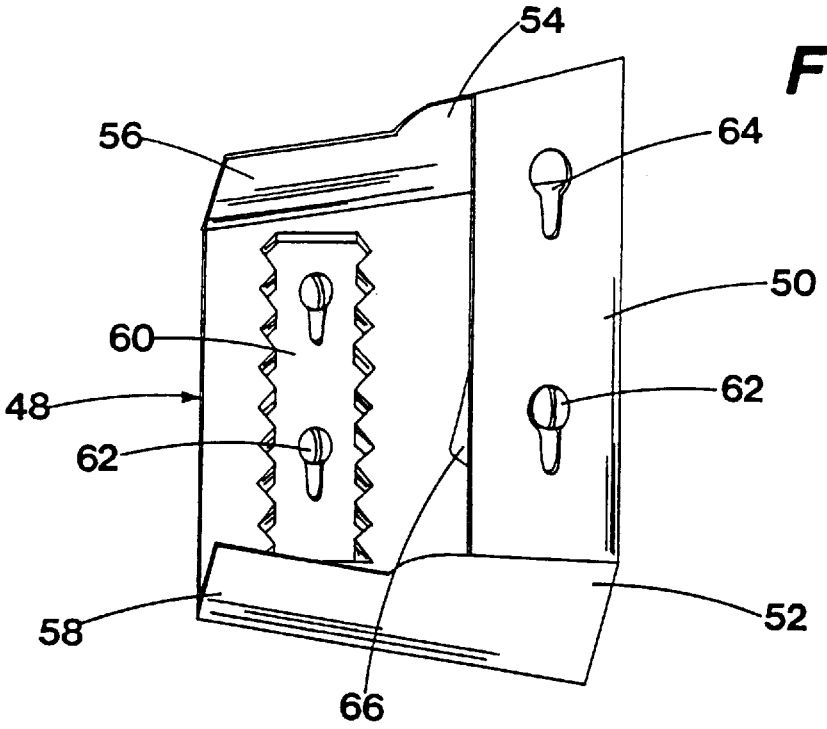
FIG. 2 is a perspective view of the pivot stop mechanism used for stopping both lenses but locking only the outside in the up position.
Figure 2A:
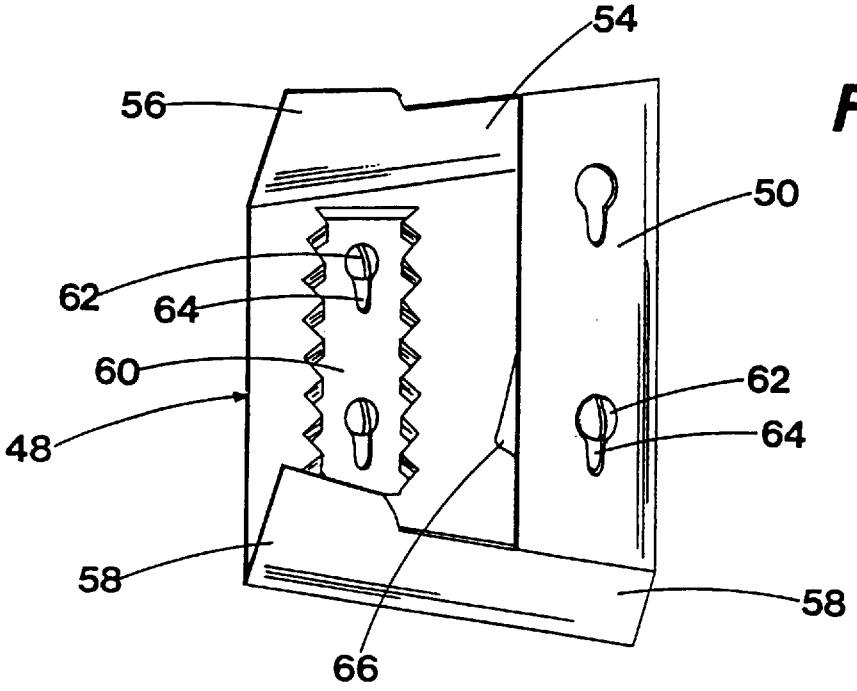
FIG. 2*a* is a perspective view of the pivot stop mechanism for stopping both lenses, but locking only the inside lens in the up position.

FIG. 2 and 2*a* show two examples of the pivot stop assembly. Both examples have identical adjustment impressions 60 and screws 62 with adjustment slots 64. A bridge 50 connects the control pivot down stop 52 and control pivot up stop 54. The control pivot arm 30 or 32 is positioned under the bridge and travels between stops 52 and 54 and is trapped in the visor up position by the saw tooth lock 66. The control pivot arm has a pocket 38 to receive the lens tab 16 at one end and a release knob 36 at the other to make it easier to release the arm from the saw tooth lock 66. FIG. 2 is an example of a stop assembly designed for the outside control pivot arm 30 with control stops 52 and 54 protruding further than the idler stop 56 and 58. This is because the control pivot is further out on the shaft than the idler.

FIG. 2*a* is an example of a stop assembly designed for the inside control pivot arm 32 with idler stops 56 and 58 protruding further than the control stop 52 and 54.

Figure 3:
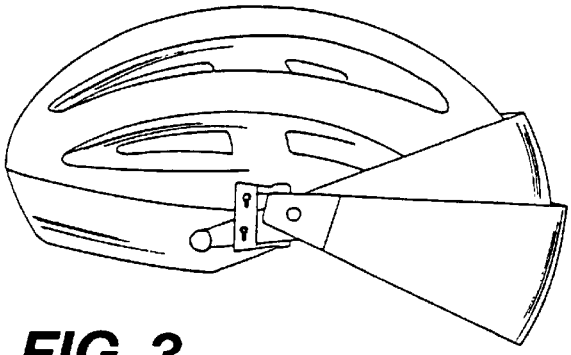
FIGS. 3 and 3*a* are simplified right and left side views showing the outside lens in a down position.
Figure 3A:
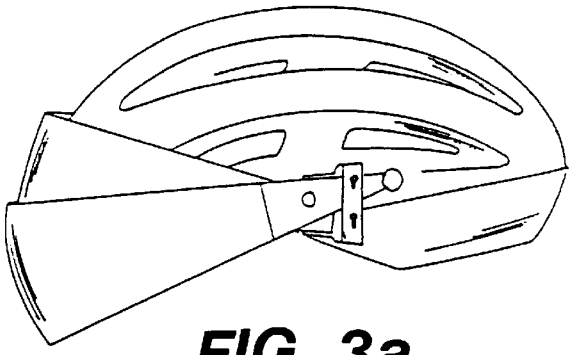

FIGS. 3 or 3*a* shows a right and left side view of a light sports helmet with the forward or outside lens in the down or deployed position and the inside lens in the locked up position.

Figure 4:
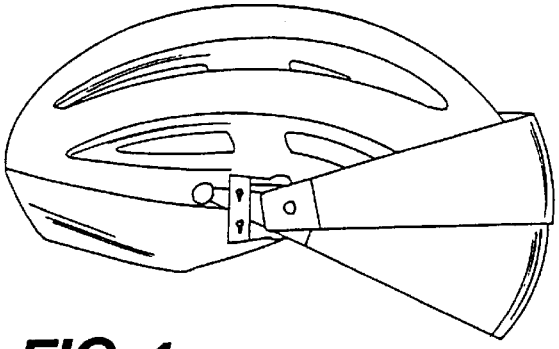
FIGS. 4 and 4*a* are simplified right and left side views showing the inside lens in a down position.
Figure 4A:
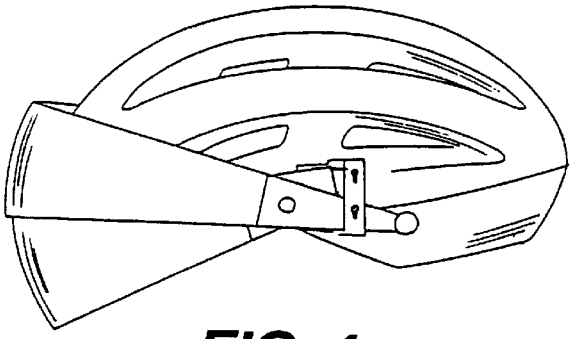

FIGS. 4 and 4*a* shows a right and left side view of a light sports helmet with inside lens in the down or deployed position and the outside lens an the up or retracted position.

Figure 5:
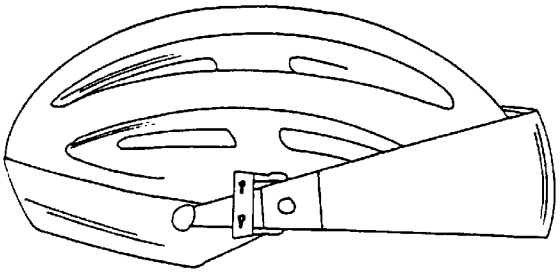
FIGS. 5 and 5*a* are simplified right and left views showing both lenses in the up or retracted position.
Figure 5A:
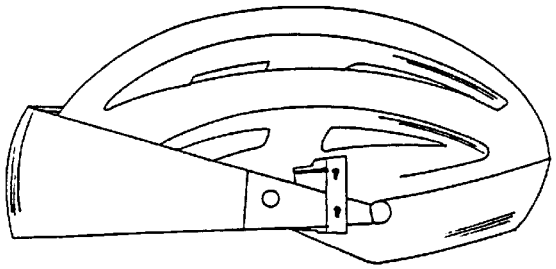

FIGS. 5 and 5*a* shows a right and left side view respectively of a light sports helmet with the invention with both lenses in the up or retracted position.

Figure 7:
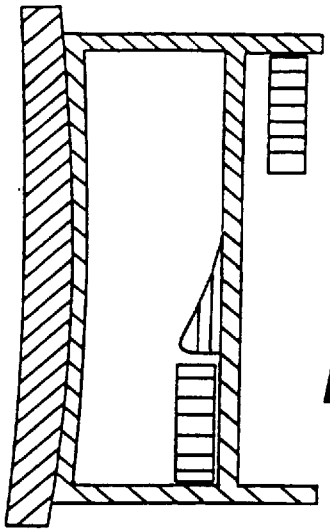
FIGS. 7 and 7*a* are simplified cross sections of the pivot stop assembly corresponding to FIG. 3 and 3*a* respectively.
Figure 7A:
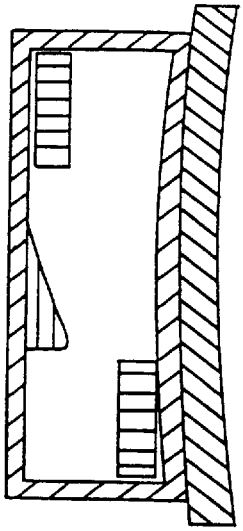

FIGS. 7 and 7*a* shows a cross section from behind of the stop assembly corresponding to FIGS. 3 and 3*a* respectively.

Figure 8:
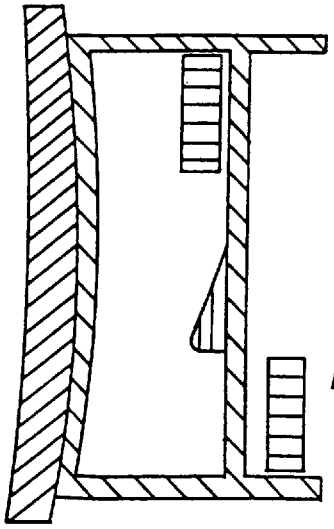
FIGS. 8 and 8*a* are simplified cross sections of the pivot stop assembly corresponding to FIG. 4 and 4*a* respectively.
Figure 8A:
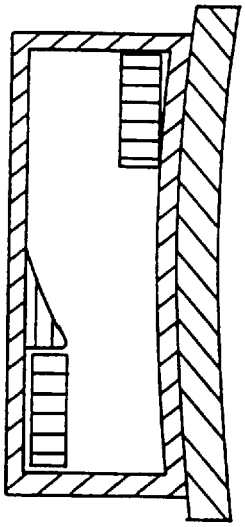

FIGS. 8 and 8*a* show a cross section from behind of the stop assembly corresponding to FIGS. 4 and 4*a* respectively.

Figure 9:
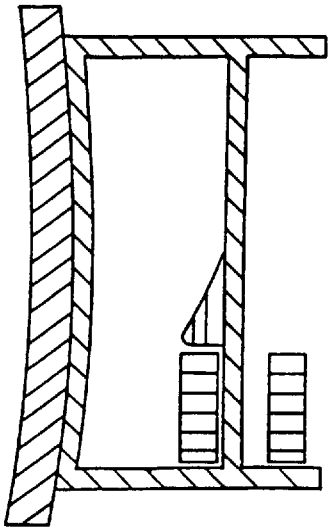
FIGS. 9 and 9*a* are simplified cross sections of the pivot stop assembly corresponding to FIG. 5 and 5*a*.
Figure 9A:
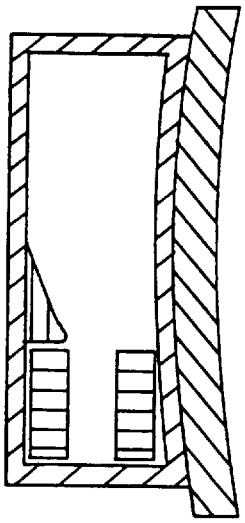

FIGS. 9 and 9*a* show a cross section from behind of the stop assembly corresponding to FIGS. 5 and 5*a* respectively.

Figure 10:
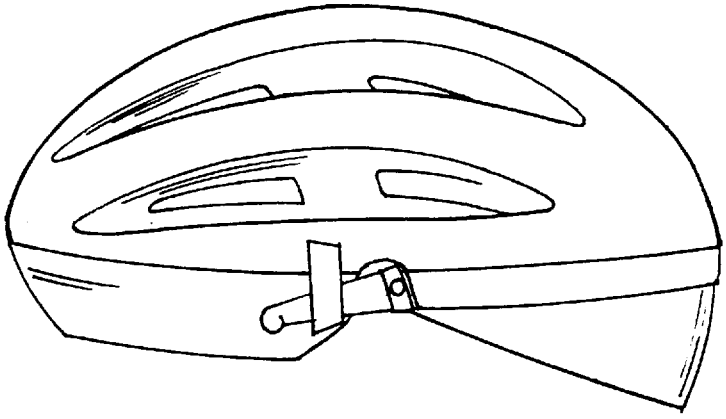
FIG. 10 is a simplified right side view showing a helmet with pocket to accommodate both lenses.

FIG. 10 shows a helmet with a pocket under the reinforced shell. This view shows one lens in the deployed position and the other in the retracted position.

Figure 10A:
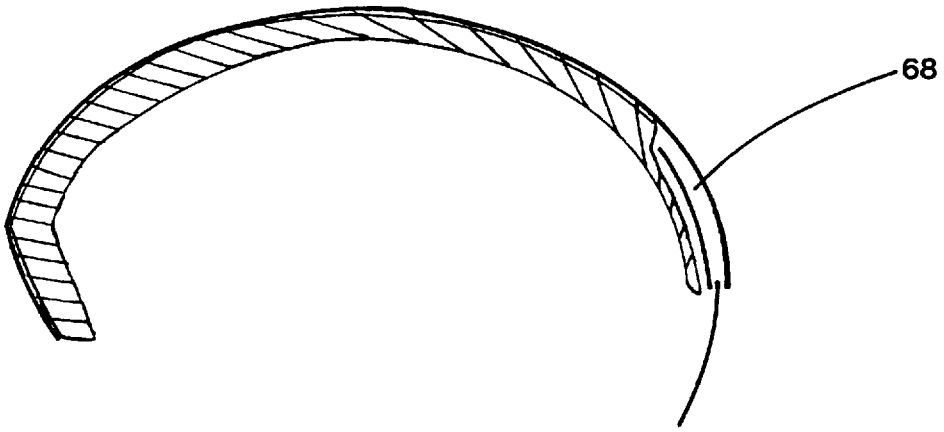
FIG. 10*a* is a simplified cross section corresponding to FIG. 10.

FIG. 10*a* is a cross section corresponding to FIG. 10.

OPERATION OF INVENTION

Assuming a standard light sports helmet of the type worn by bicycle riders. Base plates 18 are adhered at a predetermined position on either side of the helmet. Adhesive wedge shims 24 might be required to ensure a proper fit between the plate and helmet.

Attached to or a part of each base plate is a shaft 22. This shaft is attached or is manufactured as part of the base plate in such a way as to ensure that it will shear off before enough force is placed on it to twist the helmet dangerously on the rider's head. Another safety factor is the amount and type of adhesive used to attach the base plate to the helmet. It is such that the entire assembly will detach before excessive turning force is transferred to the helmet.

Mounted on the shaft are three light weight washers 26 to reduce friction and allow adequate room between the other parts on the shaft.

As seen in FIG. 1 the next items after the first washers on the shafts are an idler pivot arm on one side 28 and a control pivot arm on the other 36. AU pivoting arms have a pocket 38 on their forward edge manufactured in such a way as to accept the insertion of a lens tab 16 with only a moderate pressure. All lens tabs are identical as are all pivot arm pockets, thereby allowing the interchanging of lenses. It will be noted that the control pivot arm is longer than the idler pivot arm and that it has a release knob 36 at the far end. This knob is incorporated to give a target for the rider to touch to disengage the control pivot from the pivot locking device 66. It will also be noted that each lens be it an inside lens 14 or outside lens 12 is attached to an idler pivot arm at one end and a control pivot arm at the other.

When the rider with both lenses in the retracted position desires to lower one he or she need only give a slight inward and upward touch on the release knob to disengage the pivot lock and lower the lens until the control pivot arm hits a control pivot stop 52. On the other side of the helmet the idler pivot arm of course also rotates until it comes to rest against an idler pivot stop 58. The lens is kept in the down or deployed position by gravity. If there is a tendency for the lens to be pushed back up by air pressure when riding at high speed a locking cap 46 at the very end of the shaft need only be tightened up. This puts more pressure on a tension washer 44 which in turn increases friction to counteract the upward air pressure.

To return the lens to the retracted position the rider has only to apply a slight upward pressure and motion to the bottom edge of the lens itself. The lens will stop its upward motion when the control and idler pivot arms come up against a control pivot up stop 54 and an idler pivot up stop 56. At the same time the control pivot arm has passed a saw tooth control pivot lock 66 which keeps the lens in the retracted position. When in the retracted position the lenses are protected from scratching by a protective cover 15 which is mounted directly on shaft 22 and kept from rotating by the securing tab 17.

The pivot stop assembly 48 is attached to the back part of the base plate by means of screws 62 set in an adjustment slot 64. The adjustment slot together with an adjustment impression 60 which fits in various positions in an adjustment trough 20 allows for variation in the final up and down position of the lenses. The elongated portion of the control pivot arm with the release knob is positioned in such a way as to pass between the up and down stops and under a bridge connecting the control stops 52. The height of bridge is such that the outside surface of the control arm is in contact with the underside of the bridge 50. When the lens is pushed up the control pivot arm because it pivots on the shaft 22 moves in the opposite direction. When the control arm comes to the saw tooth lock 66 it travels up the slope away from the underside of the bridge until it comes to the end of the saw tooth whereupon it springs back to the underside of the bridge. Here the arm is trapped behind the vertical portion of the saw tooth locking the arm down and thereby the lens in the up position.

Maintaining contact between the bridge and the control arm is vital and as the distance from the base plate to an inside control arm 32 and an outside control arm 30 are different, two versions of the pivot stop assembly are required. FIGS. 2 and 2*a* are simplified examples of said control stop assemblies. FIG. 2 is a perspective of an outside pivot stop having extended control arm stops 52 and 54 while the idler stops 56 and 58 are diminished. FIG. 2*a* shows the stop positions reversed because it is designed to accommodate a closer in control arm 32 and an outer idler arm 34.

To allow for inner or outer control systems to be mounted on either the left or right side of the helmet the saw tooth lock 66 is attached to the bridge by a slot and screw 64 and 62 respectively. This allows the saw tooth to be removed and attached through the other slot and the whole assembly 48 to be mounted reversed on the other side of the helmet.

To recap the operation of this device: a bike rider wearing a helmet with this invention attached with both lenses up who finds the sunlight too bright lowers the darker lens by a small pressure and movement of the release knob. If for whatever reason a change of lenses is required the rider pushes on the lower edge of the lens, it moves up and out of the way and is automatically locked in the up position. The rider then touches the release knob on the opposite side of the helmet to deploy the second lens.

It should be understood that there is nothing stopping one from lowering the second lens without raising the first and thereby ending up with both lenses in the deployed position. Also that both these lenses can be retracted simultaneously with one upward motion. It should also be understood that for reasons of weight or economy a single lens version of this invention is possible.

SUMMARY, RAMIFICATION AND SCOPE

Thus the reader will see that this dual visor system is highly reliable, light weight, inexpensive and adaptable to most bicycle type helmets. While the above description contained many specific examples these should not be construed as limitations on the scope of the invention, but rather as an exemplification of one preferred embodiment thereof. Many other variations are possible. For example, a single visor system by eliminating the outer lens together with its parts. Springs could be added in the shaft connected to the lens. This would bring the lens down by just a touch of the release knob thereby eliminating the necessity of the hand movement of the release knob. Additional saw tooth locks could be added to the bridge to give many partial lens deployment positions.

Accordingly the invention should be determined not by the embodiment illustrated, but by the appended claims and their legal equivalents.

I claim:

1. A visor assembly for light sports helmets comprising:

a) a base plate having an adhesive thereon for affixing said base plate to each side of a a said sports helmet;

b) said base plate having a shaft originating from and at right angles to said base plate;

c) said shaft having a pivot arm journaled thereto;

d) said pivot arm having a means for controlling the pivotal range of said pivot arm;

e) said pivot arm having a means for locking said pivot arm and f) a lens fitted into said pivot arm that rotates with said pivot arm.

2. The assembly of claim 1 wherein:

a) said controlling means has a variable mounting means to allow for the positioning of said controlling means to obtain the desired pivotal ranges and b) wherein said locking means is movable to allow said pivot arm to be locked in a desired position.

3. The assembly of claim 1 wherein:

a) said adhesive is of a predetermined strength so as to allow dislodging of said plate in the event that excessive force is placed upon said plate;

b) wherein said shaft is constructed to shear from said base plate when excessive force is placed upon said shaft; and wherein c) said lens is held in said pivot arm by a predetermined frictional force that will allow the dislodging of said lens when excessive force is placed upon said lens.

4. The assembly of claim 1 further including:

a) a lightweight protective cover mounted on said shaft and attached to said helmet at a point above said lens.

5. A dual visor assembly for light sports helmets comprising:

a) a base plate having an adhesive thereon for affixing said plate to each side of said sports helmet;

b) said base plate having a shaft originating from and at right angles to said base plate;

c) said shaft having two pivot arms journaled thereto;

d) each said pivot arm having a means for controlling the pivotal range of said pivot arm;

e) a lens fitted into each said pivot arm and that rotates with each said pivot arm; and f) one of said pivot arms having a means for locking one of said pivot arms.

6. The assembly of claim 5 wherein:

a) each said pivot arm is journaled to said shaft at a predetermines different distance along their central axis;

b) wherein each said pivot arm is of a different length to allow a longer one of said pivot arms to be hand controlled;

c) wherein said locking means operates only on said longer pivot control arm;

d) wherein said longer pivot control arm on each side of said helmet are journaled on said shaft in the opposite order; and e) wherein the lenses are of the same size and interchangeable.

7. A light sports helmet with an outer reinforced shell including:

a) a shaft protruding at a right angle on each side of said sports helmet;

b) said shaft having a pivot arm journaled thereto;

c) said pivot arm having a means for controlling the pivotal range of said pivot arm;

d) said pivot arm having a means for locking said pivot arm; and e) a lens fitted into said pivot arm that rotates with said pivot arm.

8. The helmet of claim 7 wherein:

a) said controlling means has a variable mounting means to allow for the positioning of said controlling means to obtain the desired pivotal range;

b) wherein said locking means is movable to allow for said pivot arm to be locked in the desired position; and wherein c) said lens is held in said pivot arm by a predetermined frictional force to allow dislodging of said plate when excessive force is placed upon said plate.

9. The helmet of claim 7 wherein:

a) the reinforced shell of said helmet incorporates a pocket to form a protective cover for said lens.

* * * * *